US005979579A

United States Patent [19]

Jurewicz

[11] Patent Number: 5,979,579

[45] Date of Patent: Nov. 9, 1999

[54] POLYCRYSTALLINE DIAMOND CUTTER WITH ENHANCED DURABILITY

[75] Inventor: Stephen R. Jurewicz, Los Angeles, Calif.

[73] Assignee: U.S. Synthetic Corporation, Oreur, Utah

[21] Appl. No.: 08/893,832

[22] Filed: Jul. 11, 1997

[51] Int. Cl.[6] ..... E21B 10/46

[52] U.S. Cl. ..... 175/434; 175/428

[58] Field of Search ..... 175/420.2, 428, 175/434, 432

[56] References Cited

U.S. PATENT DOCUMENTS

| | | | |
|---|---|---|---|
| Re. 32,036 | 11/1985 | Dennis | 175/329 |
| 2,264,440 | 12/1941 | Havlick | 255/61 |
| 3,146,560 | 9/1964 | Hurst | 51/188 |
| 3,745,623 | 7/1973 | Wentorf, Jr. et al. | 29/95 B |
| 3,767,371 | 10/1973 | Wentorf, Jr. et al. | 51/307 |
| 3,841,852 | 10/1974 | Wilder et al. | 51/295 |
| 3,871,840 | 3/1975 | Wilder et al. | 51/295 |
| 3,913,280 | 10/1975 | Hall | 51/307 |
| 4,109,737 | 8/1978 | Bovenkerk | 175/329 |
| 4,156,329 | 5/1979 | Daniels et al. | 51/295 |
| 4,255,165 | 3/1981 | Dennis et al. | 51/309 |
| 4,268,276 | 5/1981 | Bovenkerk | 51/295 |
| 4,311,490 | 1/1982 | Bovenkerk et al. | 51/307 |
| 4,525,179 | 6/1985 | Gigl | 51/309 |
| 4,592,433 | 6/1986 | Dennis | 175/329 |
| 4,602,691 | 7/1986 | Weaver | 175/329 |
| 4,604,106 | 8/1986 | Hall et al. | 51/293 |
| 4,629,373 | 12/1986 | Hall | 407/118 |
| 4,686,080 | 8/1987 | Hara et al. | 419/8 |
| 4,694,918 | 9/1987 | Hall | 175/329 |
| 4,726,718 | 2/1988 | Meskin et al. | 408/145 |
| 4,764,434 | 8/1988 | Aronsson et al. | 428/565 |
| 4,784,023 | 11/1988 | Dennis | 76/108 A |
| 4,811,801 | 3/1989 | Salesky et al. | 175/329 |
| 4,858,707 | 8/1989 | Jones et al. | 175/329 |
| 4,872,520 | 10/1989 | Nelson | 175/329 |
| 4,913,247 | 4/1990 | Jones | 175/329 |
| 4,954,139 | 9/1990 | Cerutti | 51/293 |
| 4,984,642 | 1/1991 | Renard et al. | 175/329 |
| 4,997,049 | 3/1991 | Tank et al. | 175/410 |
| 5,007,207 | 4/1991 | Phaal | 51/204 |
| 5,011,515 | 4/1991 | Frushour | 51/307 |
| 5,016,718 | 5/1991 | Tandberg | 175/333 |
| 5,054,246 | 10/1991 | Phaal et al. | 51/204 |
| 5,120,327 | 6/1992 | Dennis | 51/293 |
| 5,135,061 | 8/1992 | Newton, Jr. | 175/428 |
| 5,154,245 | 10/1992 | Waldenstrom et al. | 175/420.2 |
| 5,158,148 | 10/1992 | Keshavan | 175/426 |
| 5,172,778 | 12/1992 | Tibbitts et al. | 175/420.1 |
| 5,217,081 | 6/1993 | Waldenstrom et al. | 175/420.2 |
| 5,248,006 | 9/1993 | Scott et al. | 175/420.2 |
| 5,264,283 | 11/1993 | Waldenstrom et al. | 428/408 |
| 5,273,125 | 12/1993 | Jurewicz | 175/420.2 |
| 5,279,375 | 1/1994 | Tibbitts et al. | 175/428 |
| 5,316,095 | 5/1994 | Tibbitts | 175/429 |
| 5,335,738 | 8/1994 | Waldenstrom et al. | 175/420.2 |
| 5,351,772 | 10/1994 | Smith | 175/428 |
| 5,355,969 | 10/1994 | Hardy et al. | 175/432 |
| 5,379,854 | 1/1995 | Dennis | 175/434 |

(List continued on next page.)

FOREIGN PATENT DOCUMENTS

| | | | |
|---|---|---|---|
| 0 133 386 | 6/1984 | European Pat. Off. | B23P 5/00 |
| 2 240 797 | 8/1991 | United Kingdom | E21B 10/46 |
| 2 290 326 | 12/1995 | United Kingdom | E21B 10/46 |
| 2 290 327 | 12/1995 | United Kingdom | E21B 10/46 |
| 2 290 328 | 12/1995 | United Kingdom | E21B 10/46 |

*Primary Examiner*—William Neuder
*Attorney, Agent, or Firm*—Lloyd W. Sadler

[57] ABSTRACT

A cutting element is provided for use with drill used in the drilling and boring through subterranean formations. This new cutter has improved wear characteristics while maximizing the manufacturability and cost effectiveness of the cutter. This invention accomplishes these objectives by incorporating a single chamfer of increased size. This chamfer is introduced on the periphery of the abrasive cutting face of the cutter. This chamfer has been found to reduce the tensile stress within the cutter, which tensile stress is primarily responsible for spalling and delamination of the abrasive layer of the cutter.

21 Claims, 7 Drawing Sheets

U.S. PATENT DOCUMENTS

| | | | |
|---|---|---|---|
| 5,435,403 | 7/1995 | Tibbitts | 175/432 |
| 5,437,343 | 8/1995 | Cooley et al. | 175/434 |
| 5,443,565 | 8/1995 | Strange, Jr. | 175/431 |
| 5,460,233 | 10/1995 | Meany et al. | 175/428 |
| 5,469,927 | 11/1995 | Griffin | 175/432 |
| 5,472,376 | 12/1995 | Olmstead et al. | 451/540 |
| 5,486,137 | 1/1996 | Flood et al. | 451/540 |
| 5,494,477 | 2/1996 | Flood et al. | 451/540 |
| 5,499,688 | 3/1996 | Dennis | 175/434 |
| 5,544,713 | 8/1996 | Dennis | 175/434 |
| 5,564,511 | 10/1996 | Frushour | 175/431 |
| 5,722,499 | 3/1998 | Nguyen et al. | 175/434 |
| 5,758,733 | 6/1998 | Scott et al. | 175/434 |

POLYCRYSTALLINE DIAMOND CUTTER WITH ENHANCED DURABILITY

BACKGROUND OF THE INVENTION

1. Field of the Invention

This invention relates to devices for drilling and boring through subterranean formations. More specifically, this invention is a polycrystalline diamond cutter intended to be installed as the cutting element of a drill bit to be used for boring through rock in any application requiring drilling through geological formations, such as oil, gas, mining, and/or geothermal exploration or exploitation.

2. Description of Related Art

Three types of drill bits are most commonly used in penetrating geologic formations. These are: (a) percussion bits; (b) rolling cone bits, also referred to as rock bits; and (c) drag bits, or fixed cutter rotary bits. Drag bits predominately employ polycrystalline diamond inserts as the primary cutting device.

In addition to the drill bits discussed above, other down hole tools that may employ polycrystalline diamond cutters include, but are not limited to: reamers, stabilizers, and tool joints. Similar devices used in the mining industry may also use this invention.

Percussion bits penetrate through subterranean geologic formations by an extremely rapid series of impacts. The impacts may be combined with a simultaneous rotation ob the bit.

Rolling cone bits make up the largest number of bits used in drilling geologic formations. Rolling cone bits have as their primary advantages that they are able to penetrate hard geologic formations and that they are generally lower in cost. Typically rolling cone bits operate by rotating three cones, each oriented substantially transversely to the bit's axis in a triangular arrangement, with the narrow end of each cone facing a point in the direct center of the bit. An exemplary rolling cone bit is shown in FIG. 1.

The rolling cone bit cuts through rock by the crushing and scraping action of the abrasive inserts embedded in the surface of the rotating cone. These abrasive inserts are generally composed of cemented tungsten carbide, but may also include polycrystalline diamond coated cemented tungsten carbide, where increased wear performance is required. Rolling cone bits in common usage may achieve rates of penetration ("ROP") through hard geologic formations ranging from one to thirty feet per hour.

A third type of bit is the drag bit, also known as the fixed cutter bit. An exemplary of a drag bit is shown in FIG. 2. The drag bit is designed to be rotated about it's longitudinal axis. Most drag bits employ polycrystalline diamond cutting elements ("PDCs"), which are brazed into the cutting blade of the bit. Typically, a PDC consists of a polycrystalline diamond layer that is formed on the top surface of a substrate material. The substrate material is generally a cemented tungsten carbide. The present state of the art in drag bits may achieve rates of penetration ranging form one to in excess of one thousand feet per hour. A major disadvantage of present drag bit technology is that they tend to be susceptible to premature wear due to impact failure. Impact failure is cause by the bit encountering highly stressed or tough formations such as limestone, dolomites, or soft formations containing hard "stringers or lenses" of these tough rocks.

It is expected that this invention will find primary application in drag bits, although some use in rolling cone bits and even percussion bits is also envisioned.

A polycrystalline diamond cutting element ("PDC") is typically fabricated by placing a disk-shaped cemented tungsten carbide substrate into a refractory metal container ("can") with a layer of diamond crystal powder placed into the can adjacent to one face of the substrate. The can is then covered. A number of such can assemblies are loaded into a high pressure cell made from a soft ductile solid material such as pyrophyllite or talc. The loaded high pressure cell is then placed in an ultra-high pressure press. The entire assembly is compressed under ultra-high pressure and temperature conditions. This causes the metal binder from the cobalt substrate to become liquid and to "sweep" from the substrate face through the diamond grains and to act as a reactive liquid phase promoting the sintering of the diamond grains. The sintering of the diamond grains causes the formation of a polycrystalline diamond structure. As a result the diamond grains become mutually bonded to form a diamond table over the substrate face. The metal binder may remain in the diamond layer within the pores of the polycrystalline structure or, alternatively, it may be removed via acid leeching and optionally replaced by another material forming so-called thermally stable diamond ("TSD"). Variations of this general process exist in the related art. This detail is provided so the reader may become familiar with the concept of sintering a diamond layer onto a substrate to form a PDC insert. For more information concerning this process, the reader is directed to U.S. Pat. No. 3,745,623, issued on Jul. 7, 1973 to Wentorf Jr. Et al.

Existing art PDCs exhibit durability problems in cutting through tough geologic formations, where the cutting edge may experience high stress loads which may be transient in nature. Under such conditions, existing PDCs have a tendency to crack, spall, and break. Similarly, existing PDCs are weak when placed under high loads from a variety of angles. These problems of existing PDCs are further exacerbated by the dynamic nature of both normal and torsional loading during the drilling process, whereby the fit face moves into and out of contact with the uncut material forming the bottom of the well bore. The loading is further aggravated in some bit designs by the tendency of the bit to "whirl".

The interface between the diamond layer and the tungsten carbide substrate must be capable of sustaining the high residual stresses that arise from the thermal expansion and bulk modulus mismatches between the two materials. These differences create high stress concentrations at the interface as the materials are cooled from the high temperature and pressure process. Furthermore, finite element modeling of these stress concentrations indicate that there are localized regions of high tensile stress in the outer edge and the middle of the cylindrical diamond layer. Both of these phenomena are deleterious to the life of the PDC cutting elements during drilling operations, when high tensile stresses in the diamond layer at the cutting edge may cause fracture, spalling, or complete delamination of the diamond layer from the substrate.

Most prior PDCs have a relatively thin diamond layer, generally between 0.020 inches to 0.035 inches in thickness. The cylinder of carbide that the diamond layer is adhered to is generally three to ten times larger than the diamond layer. Diamond is an extremely good thermal conductor, especially when compared to the tungsten carbide substrate to which it is attached. The use of so much carbide in relation to the diamond reduced the potential for heat transfer from the cutter to the drilling fluids, thereby further reducing the durability of the PDC. Drilling fluids are used to cool the cutter and to flush the cuttings from the workface.

Diamond is used as a drilling material primarily because of its extreme hardness and strength. However, diamond also has a major drawback. Diamond, as a cutting material, has very poor toughness, that is, it is very brittle. Therefore, anything that further reduces the diamond's toughness, substantially degrades its durability.

Others have previously attempted to enhance the durability of conventional PDCs. By way of example, the reader is directed to U.S. Pat. No. Re. 32,036, issued to Dennis; U.S. Pat. No. 4,592,433, issued to Dennis; and U.S. Pat. No. 5,120,327, issued to Dennis. Each of these patents discuss the use of beveling of the peripheral edge of the cutter. Such minor beveling, also referred to as chamfers, were originally designed to protect the cutting edge of the PDC during the initial stages of the drilling. A sharp cutting edge is very brittle and has a tendency to chip or spall with the slightest impact. The bevel protects the cutting edge by providing a small load bearing area which lowers the unit stresses during the initial stages of drilling.

In is also known in the art to radius, rather than chamfer, the cutting edge of a PDC. This approach is disclosed in U.S. Pat. No. 5,016,718 issued to Tandberg. Such radiusing has been demonstrated to provide a load-bearing area similar to that of a small peripheral chamfer on the cutting edge.

A number of other approaches and applications of PDCs are well established in related art. The applicant includes the following references to related art patents for the reader's general familiarization with this technology.

U.S. Pat. No. 2,264,440 describes a diamond abrasive drill bit for drilling holes for blasting or grouting where no core is required.

U.S. Pat. No. 3,745,623 describes diamond tools and superpressure processes for the preparation thereof, the diamond content being supported on and being directly bonded to an extremely stiff substrate, often made of sintered carbide.

U.S. Pat. No. 3,767,371 discloses abrasive bodies that comprise combinations of cubic boron nitride crystals and sintered carbide.

U.S. Pat. No. 3,841,852 describes abraders, abrasive particles and methods for producing same, where the preferred primary abrasive is a diamond.

U.S. Pat. No. 3,871,840 reveals how abrasive particles are improved in function by encapsulating them with a metallic envelope.

U.S. Pat. No. 3,913,280 describes a polycrystalline diamond composite and a method for forming diamond to diamond bonds between adjacent diamond particles.

U.S. Pat. No. 4,156,329 describes a method for fabricating a drill bit comprised of a plurality of composite compact cutters.

U.S. Pat. No. 4,268,276 describes a compact for cutting, drilling, wire drawing and shaping tools, consisting essentially of a porous mass of self-bonded, boron-doped diamond particles and catalyst-solvent material.

U.S. Pat. No. 4,311,490 discloses an improved process for preparing a composite compact wherein a mass of abrasive crystals, a mass of metal carbide, and a bonding medium are subjected to a high-temperature/high pressure process for providing a composite compact. The resulting composite compact is also disclosed therein.

U.S. Pat. No. Re. 32,036 discloses a drill bit for connection on a drill string, the drill bit having a hollow tubular body with an end cutting face and an exterior peripheral stabilizer surface with cylindrical sintered carbide inserts positioned therein.

U.S. Pat. No. 4,592,433 discloses a cutting blank that comprises a substrate formed of a hard material and including a cutting surface with a plurality of shallow grooves that contain strips of a diamond substance.

U.S. Pat. No. 4,604,106 reveals a composite polycrystalline diamond compact comprising a least one layer of diamond crystals and precemented carbide pieces which have been pressed under sufficient heat and pressure to create composite polycrystalline material wherein polycrystalline diamond and the precemented carbide pieces are interspersed in one another.

U.S. Pat. No. 4,605,343 discloses a sintered polycrystalline diamond compact having an integral metallic heat sink bonded to and covering a least the outer diamond surface.

U.S. Pat. No. 4,629,373 discloses a polycrystalline diamond body with a plurality of faces having enhanced surface irregularities over at least a portion of at least one of the faces, the polycrystalline diamond body with the enhanced surface irregularities being attached to other materials, such as metal.

U.S. Pat. No. 4,694,918 describes an insert that has a tungsten carbide body and at least two layers at the protruding drilling portion of the insert. The outermost layer contains polycrystalline diamond and the remaining layers adjacent to the polycrystalline diamond layer are transition layers containing a composite of diamond crystals and precemented tungsten carbide, the composite having a higher diamond crystal content adjacent to the polycrystalline diamond layer and a higher precemented tungsten carbide content adjacent to the tungsten carbide layer.

U.S. Pat. No. 4,764,434 reveals a polycrystalline diamond tool comprising a diamond layer bonded to a support body having a complex, non-planar geometry by means of a thin and continuous layer of a refractory material applied by a coating technique, such as PVD or CVD.

U.S. Pat. No. 4,811,801 describes an insert that includes a polycrystalline diamond surface on an insert body having a head portion made from a material with elasticity and thermal expansion properties advantageously tailored for use in rock bits, as well as rock bits made with such inserts.

U.S. Pat. No. 4,913,247 describes a drill bit having a body member with cutter blades having a generally parabolic bottom profile.

U.S. Pat. No. 5,016,718 reveals a polycrystalline diamond cutting element whose mechanical strength is improved due to the fact that the edge of the element is rounded with a small visible radius.

U.S. Pat. No. 5,120,327 describes a composite for cutting in subterranean formations, comprising a cemented carbide substrate and a diamond layer adhered to the surface of the substrate.

U.S. Pat. No. 5,135,061 describes a preform cutting element for rotary drill bit use in drilling or boring holes in substrate formations, which includes a cutting table of superhard material such as polycrystalline diamond.

U.S. Pat. No. 5,154,245 relates to a rock bit insert of cemented carbide for percussive or rotary crushing rock drilling. The button insert is provided with one or more bodies of polycrystalline diamond in the surface produced a high pressure and high temperature in the diamond stable area. Each diamond body is completely surrounded by cemented carbide except the top surface.

U.S. Pat. No. 5,158,148 describes cemented tungsten carbide rock bit inserts having diamond particles dispersed therein for enhanced hardness and wear resistance.

U.S. Pat. No. 5,217,081 relates to a rock bit insert of cemented carbide provided with one or more bodies or layers of diamond and/or cubic boron nitride produced at high pressure and high temperature in the diamond oar cubic boron nitride stable area. The body of cemented carbide has a multi-structure containing eta-phase surrounded by a surface zone of cemented carbide free of eta-phase and having a low content of cobalt in the surface and a higher content of cobalt next to the eta-phase zone.

U.S. Pat. No. 5,248,006 describes a cutting structure having diamond filled compacts for use in an earth boring bit of the type having one or more rotatible cones secured to bearing shafts.

U.S. Pat. No. 5,264,283 relates to buttons, inserts and bodies that comprise cemented carbide provided with bodies and/or layers of CVD- or PVD-fabricated diamond and then high pressure/high temperature treated in the diamond stable area.

U.S. Pat. No. 5,279,375 describes a multidirectional drill bit cutter comprising a cylindrical stud having a layer of polycrystalline diamond formed thereabout.

U.S. Pat. No. 5,335,738 relates to a button of cemented carbide. The button is provided with a layer of diamond produced at high pressure and high temperature in the diamond stable area. The cemented carbide has a multi-phase structure having a core that contains eta-phase surrounded by a surface zone of cemented carbide free of eta-phase.

U.S. Pat. No. 5,351,772 discloses a substantially polycrystalline diamond compact element for drilling subterranean formations. The cutting element includes a cemented carbide substrate having radially extending raised lands on one side thereof, to and over which is formed and bonded a polycrystalline diamond table.

U.S. Pat. No. 5,355,969 describes a cutting implement formed from a substrate of carbide, or other hard substance, bonded to a polycrystalline layer which serves as the cutting portion of the implement. The interface between the substrate and the polycrystalline layer is defined by surface topography with radially spaced-apart protuberances and depressions forming smooth transitional surfaces.

U.S. Pat. No. 5,379,854 discloses a cutting element which has a metal carbide stud with a plurality of ridges formed in a reduced or full diameter hemispherical outer end portion of said metal carbide stud. The ridges extend outwardly beyond the outer end portion of the metal carbide stud. A layer of polycrystalline material, resistant to corrosive and abrasive materials, is disposed over the ridges and the outer end portion of the metal carbide stud to form a hemispherical cap.

U.S. Pat. No. 5,435,403 describes a cutting element having a substantially planar table of superhard material mounted on a substrate or backing.

U.S. Pat. No. 5,437,343 describes a diamond cutting element including a substantially planar diamond table having a periphery defined by a multiple chamfer.

U.S. Pat. No. 5,443,565 describes a drill bit characterized by a body fitted with multiple, spaced blades having a forward sweep relative to the center of the bit and cutting elements embedded in the blades at a selected back rake and side rake.

U.S. Pat. No. 5,460,233 describes a rotary drag bit for drilling hard rock formations with substantially planar PDC cutting elements having diamond tables backed by substrates which flare or taper laterally outwardly and rearwardly of the cutting edge of the diamond table.

U.S. Pat. No. 5,472,376 describes a tool component comprising an abrasive compact layer bonded to a cemented carbide substrate along an interface.

U.S. Pat. No. 5,486,137 discloses an abrasive tool insert having an abrasive particle layer having an upper surface, an outer periphery, and a lower surface integrally formed on a substrate which defines an interface there between.

U.S. Pat. No. 5,494,477 describes an abrasive tool insert comprising a cemented substrate and a polycrystalline diamond layer formed thereon by high pressure, high temperature processing.

U.S. Pat. No. 5,544,713 discloses a cutting element with a metal carbide stud that has a conic tip formed with a reduced diameter hemispherical outer tip end portion of said metal carbide stud. A corrosive and abrasive resistant polycrystalline material layer is also disposed over the outer end portion of the meal carbide stud to form a cap, and an alternate conic form has a flat tip face. A chisel insert has a transecting edge and opposing flat faces, which chisel insert is also covered with a polycrystalline diamond compact layer.

U.K Patent Application No. 2,240,797A discloses a preform cutting element for a rotary drill bit comprising a polycrystalline diamond cutting table bonded to a coextensive substrate of cemented tungsten carbide.

Each of the aforementioned patents and elements of related art is hereby incorporated by reference in its entirety for the material disclosed therein.

SUMMARY OF THE INVENTION

It is desirable to provide a cutter, for use in drill bits which are used to bore through subterranean geologic formations, which has increased durability. This invention provides this increased durability through a relatively simple though innovative modification of the geometry of the diamond layer. This modification may be used on existing currently available cutters to dramatically improve their impact life.

It is the general objective of this invention to improve cutter durability by modifying the geometry of the diamond layer to include a single chamfer region with an increased size on the periphery of the cutter.

It is a further objective of this invention to provide a cutter with a chamfer size ranging from 0.020 inches to 0.035 inches as measured parallel to the longitudinal axis on the side wall of the cutter.

It is further objective of this invention to provide a chamfer size modification that can be performed on existing cutters that have an exposed diamond thickness at the periphery in the range of from 0.025 inches to 0.070 inches.

It is a further objective of this invention to provide a cutter configuration that provides an increased load bearing area at the diamond edge.

It is a further objective of this invention to provide a cutter configuration that physically reduces the region of high tensile stress which concentrates on the outer periphery of the cutter in approximately the middle of the diamond layer.

It is a further objective of this invention to provide a cutter configuration that increases the load bearing area of the cutter, thereby more efficiently distributing the loads which act to spall the diamond layer.

It is a further objective of this invention to provide a cutter with an increased diamond table thickness, ranging from 0.025 inches to approximately 0.069 inches to provide the greatest possible durability improvement.

It is a further objective of this invention to provide a cutter geometry that decreases the occurrences of PDC cracking and spalling in hard geologic formations.

It is a further objective of this invention to provide a cutter geometry that decreases the residual stresses that occur on the outer periphery of the diamond layer.

It is a further objective of this invention to provide a cutter that can be used on drag bits, roller cone bits, percussion bits and other downhole tools.

It is a further objective of this invention to provide a cutter that when installed on a drag bit, increases the performance of the drag bit in hard rock formations.

It is a further objective of this invention to provide a cutter which can be manufactured using current manufacturing methods.

It is a further objective of this invention to provide a cutter which is composed of a diamond layer sintered to a substrate of a cemented metal carbide selected from the group comprising tungsten, niobium, zirconium, hafnium, vanadium, tantalum, and titanium.

These and other objectives, features and advantages of this invention, which will be readily apparent to those of ordinary skill in the art, are achieved by the invention as described in this application.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DETAILED DESCRIPTION OF THE INVENTION

Figure 1:
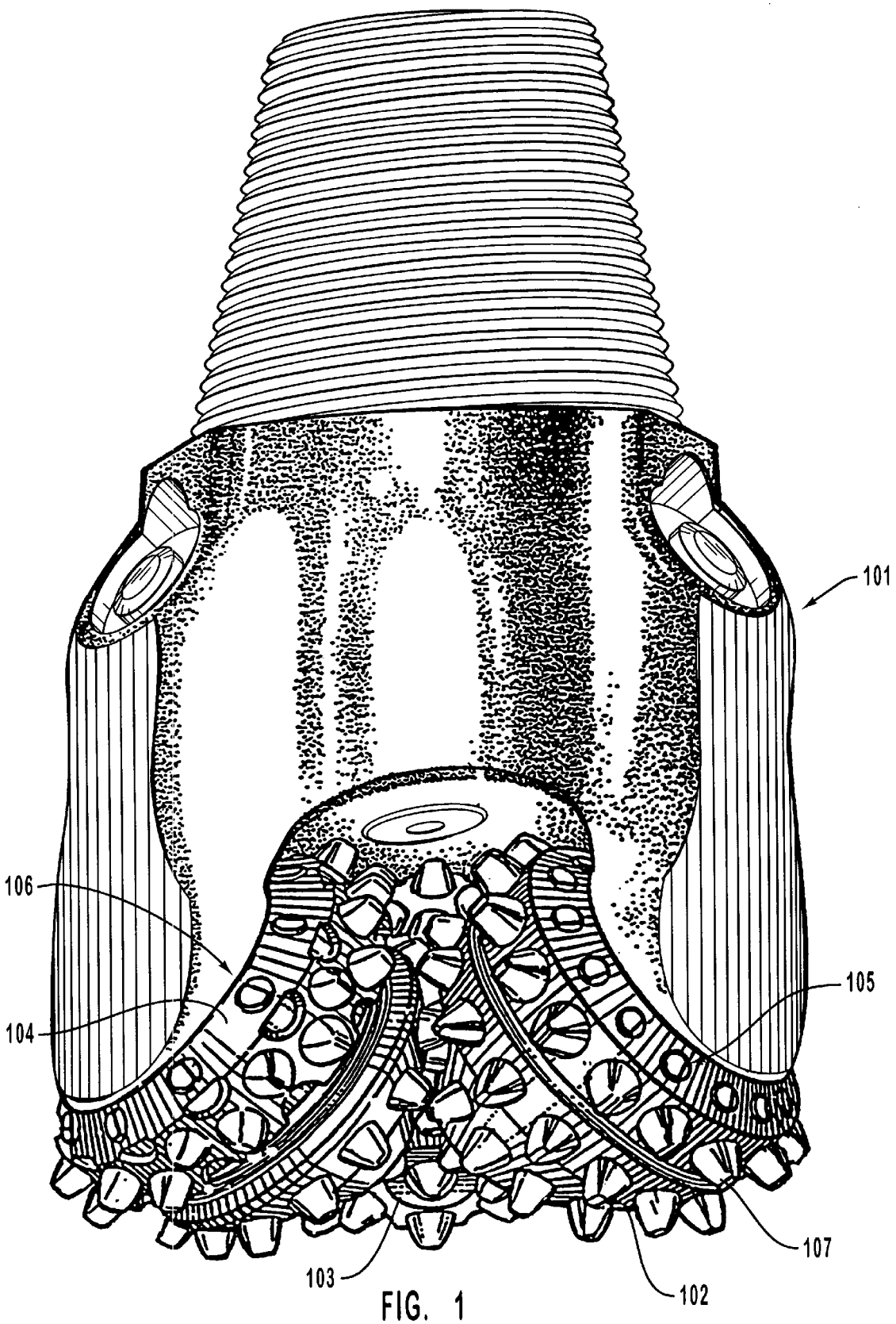
FIG. 1 (Prior Art)
FIG. 1 depicts an exemplary related art roller cone earth boring bit.

FIG. 1 depicts an example of a typical rolling cone bit 101. This rolling cone bit 101 includes three rotating cones 102, 103, 104. Each rotating cone 102, 103, 104 includes a plurality of cutting teeth 107. The polycrystalline diamond cutters of this invention are shown being used as gage cutters 105 and as wear pads 106.

Figure 2:
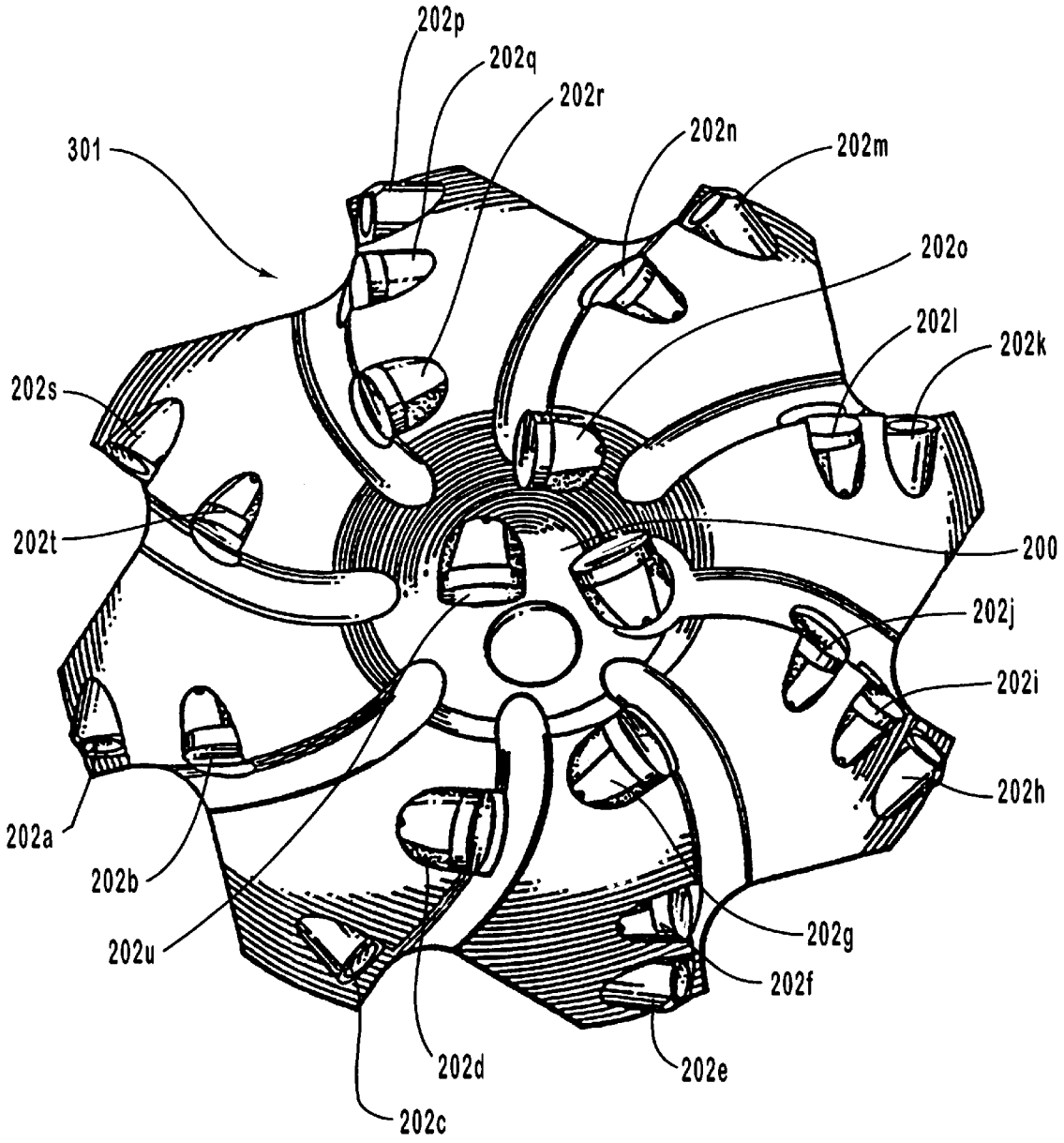
FIG. 2 (Prior Art)
FIG. 2 depicts an exemplary related art drag or fixed cutter bit.

FIG. 2 depicts the side view of an example of a typical drag bit 201. A number of cutters, which could be of the type described in this invention are shown 201*a–t* arranged in rows emanating in a generally radial fashion from the approximate center 205 of the bit. It is expected by the inventor that the invention can be used on drag bits of virtually any configuration.

Figure 3A:
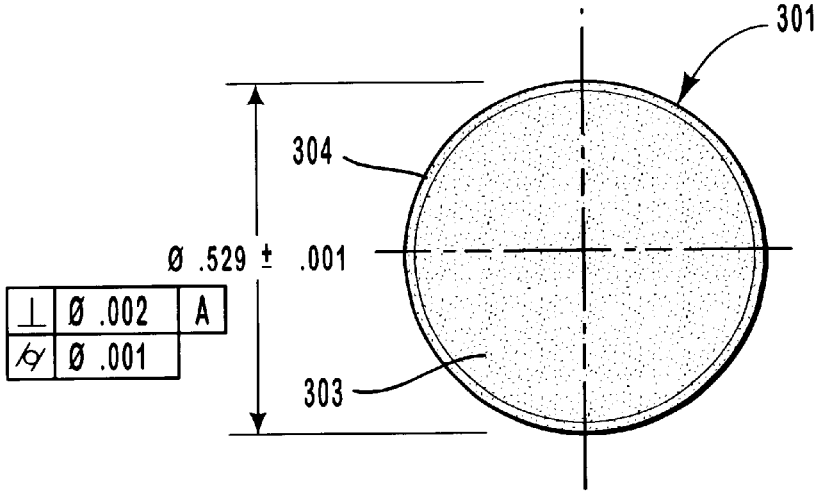
FIG. 3 depicts an exemplary related art polycrystalline diamond cutter.
Figure 3B:
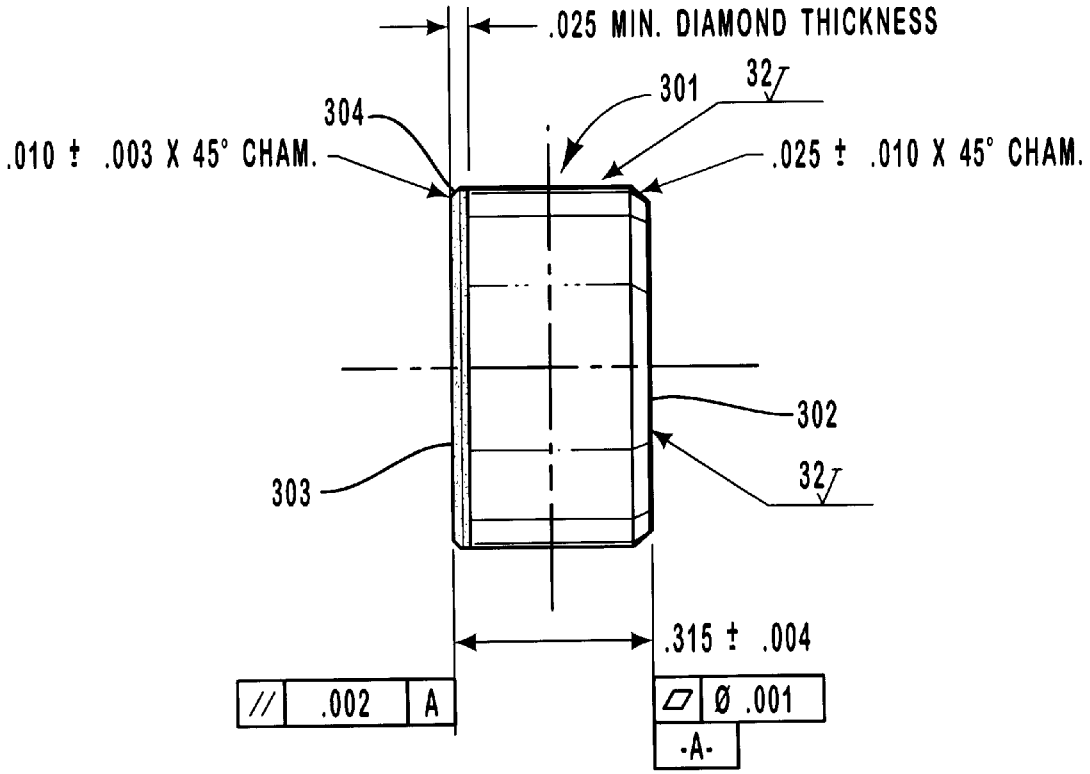

FIG. 3 depicts the side view of a typical related art polycrystalline diamond cutter 301 for use in drag bits. The cutter 301 is shown to be cylindrical in shape. It consists of a substrate section 302, which generally consists of a cemented tungsten carbide and a sintered polycrystalline diamond layer 303 formed onto the substrate 302 by a standard well known manufacturing process. The polycrystalline diamond layer 303 of the cutter 301 is shown with a standard chamfer 304 on the periphery of the diamond layer. This existing cutter 301 may be directly mounted to the face of a drag bit 201 or secured to a stud which is itself secured to the face of the bit.

Figure 4:
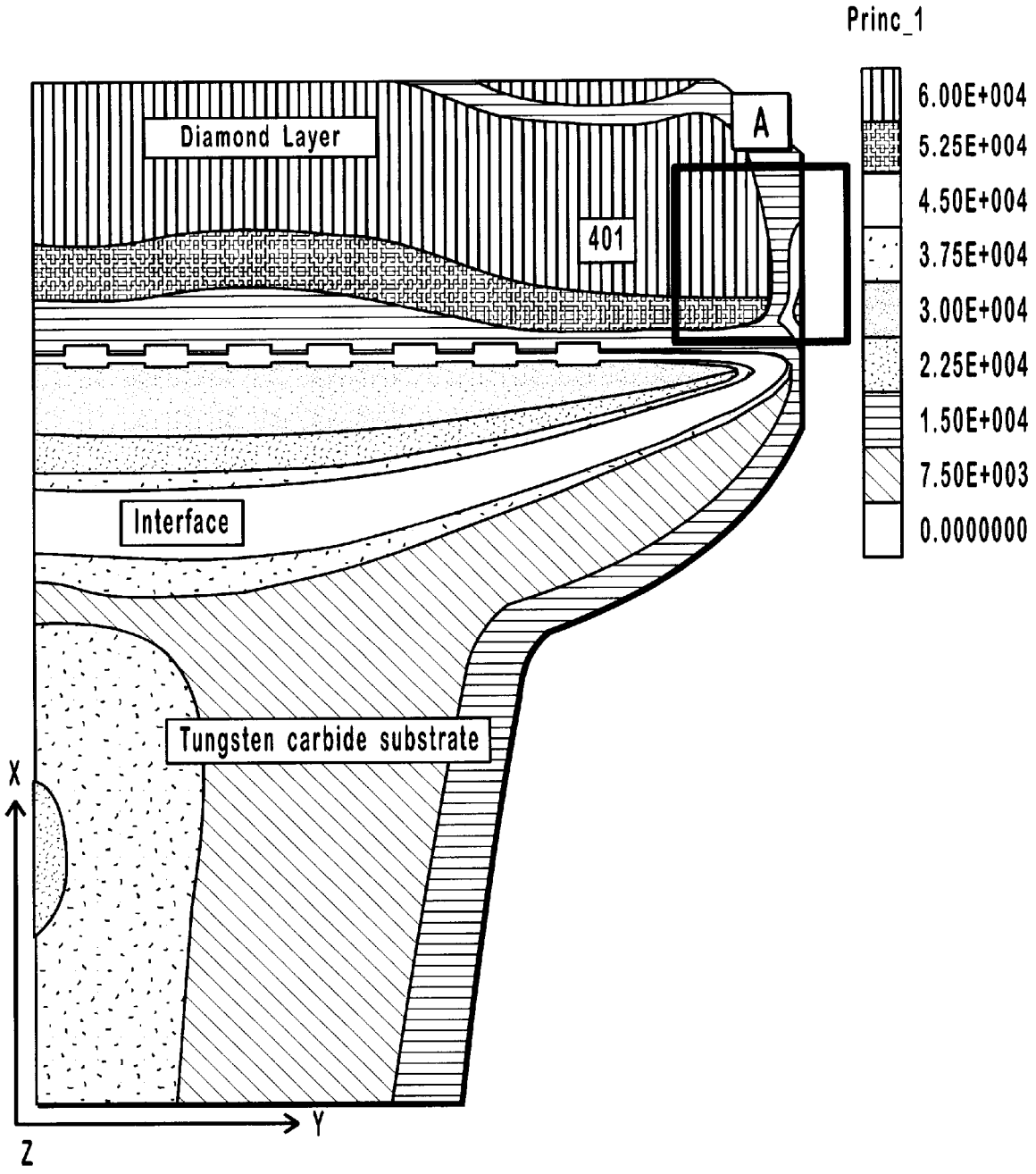
FIG. 4 depicts a two-dimensional residual stress model of a typical related art cutter with a chamfer.

FIG. 4 depicts the residual stress pattern of a standard cutter 301 with a typical chamfer size of 0.010 inches. FIG. 4 was determined through finite element modeling. The boxed area 401 denotes a region of high tensile stress, that occurs in the outer periphery of the diamond layer. The high tensile stress within this region is primarily responsible for diamond layer spalling and delamination which occurs during hard formation drilling. The colors shown in FIG. 4 range from Red, which illustrates the highest tensile stress regions, to green-blue which illustrates a neutral stress region, to purple which illustrates the highest compressive stress regions.

Figure 5:
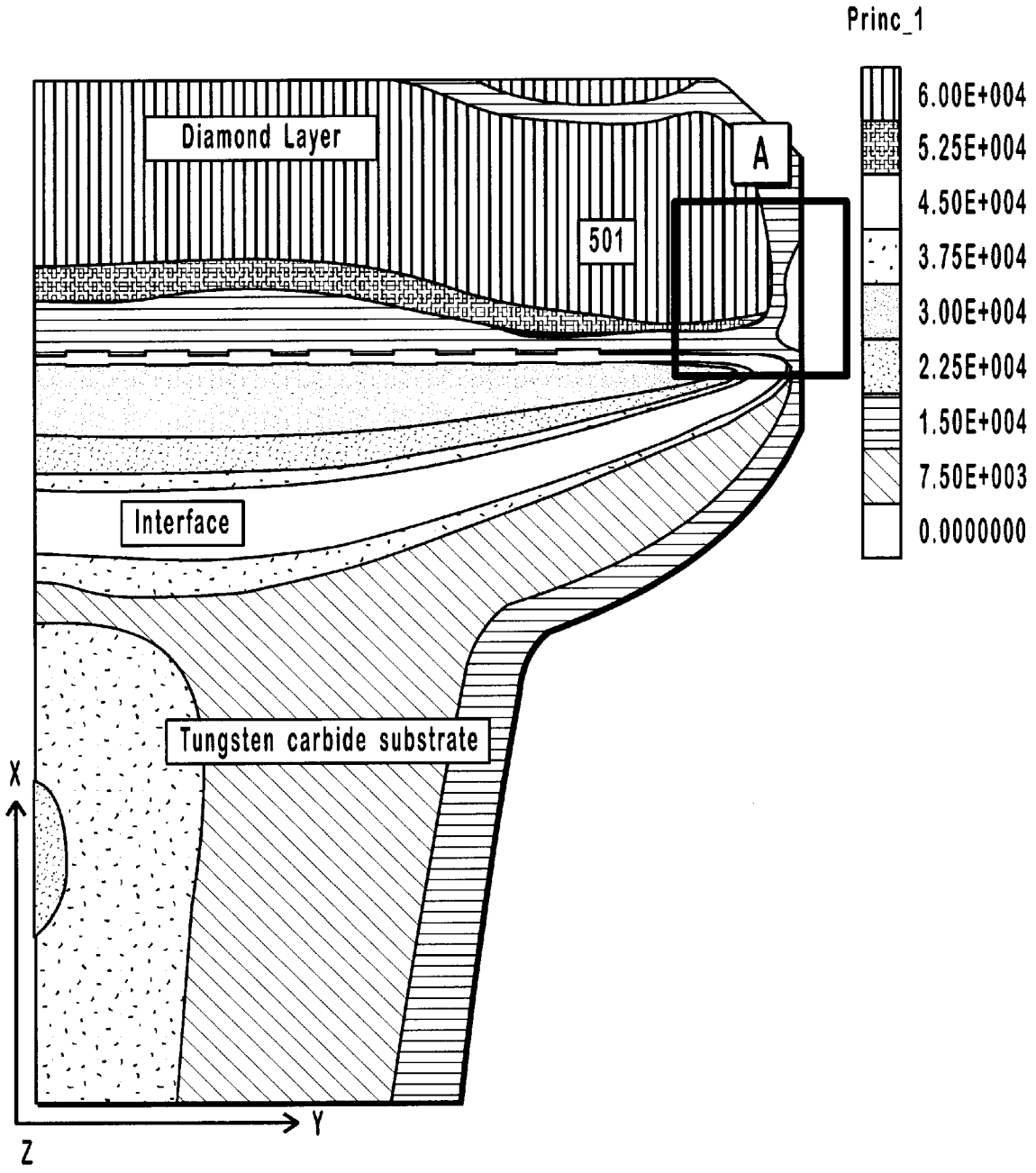
FIG. 5 depicts a two-dimensional residual stress model of a typical related art cutter with the larger chamfer of this invention.

FIG. 5 depicts the same standard cutter 301 of FIG. 4, which has been modified by the applicant's invention to provide a larger chamfer on the diamond layer. The boxed area 501 denotes the same region on the outer periphery of the diamond layer as the boxed area 401 of FIG. 4. It is readily apparent from comparing the FIG. 4 and FIG. 5 that the high tensile stress region in the outer periphery of the diamond layer is substantially reduced in the cutter with the larger chamfer.

Figure 6A:
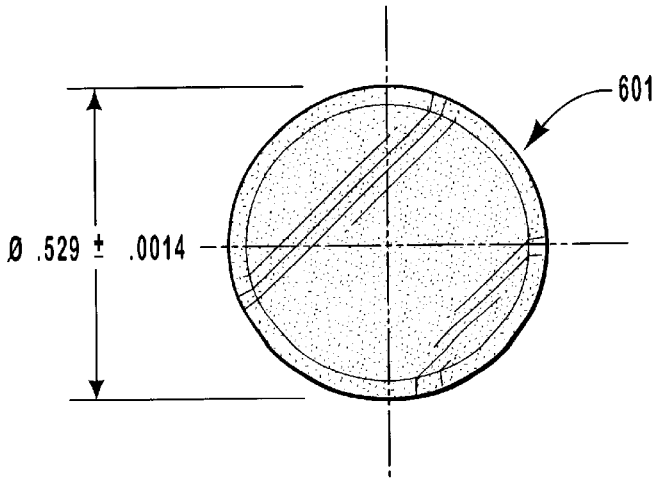
FIG. 6 depicts a preferred embodiment of the invention as used on a cutter with preferred diamond layer thickness.
Figure 6B:
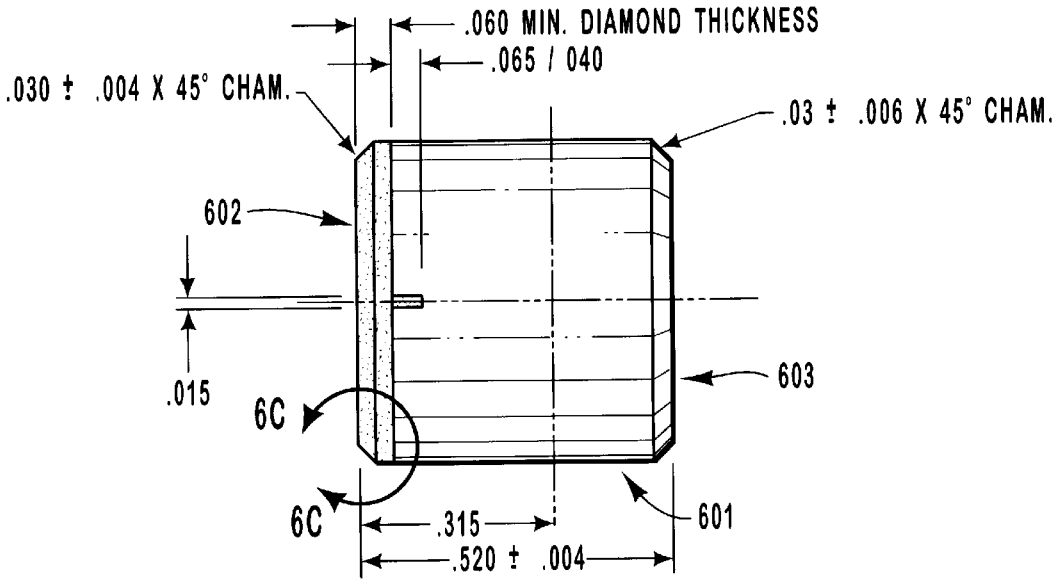
Figure 6C:
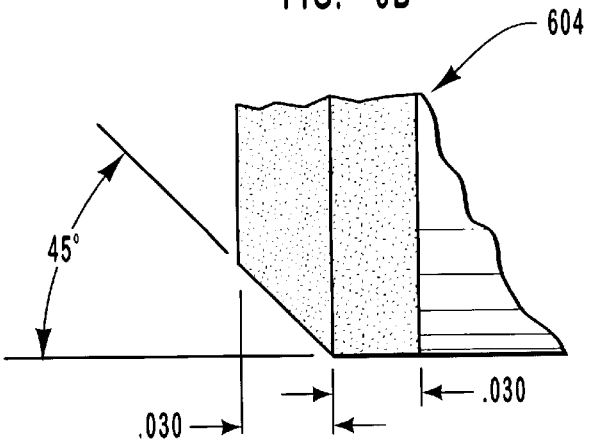

FIG. 6 depicts the preferred embodiment of the cutter invention 601 described in this application. The preferred embodiment of the cutter 601 has a diamond layer 602 bonded to a tungsten carbide substrate 603. The diamond layer 601 has a minimum diamond thickness of 0.060 inches. On the periphery of the diamond layer is chamfer 604. Chamfer 604 has a depth of 0.030 inches and a surface length of 0.043 inches. The chamfer 604 is imposed on the diamond layer at an angle of 45 degrees. The preferred chamfer 604 is cut to approximately one-half of the diamond layer thickness. In the preferred cutter 601, the chamfer depth dimension is in the range of from 0.020 inches to 0.035 inches. The preferred angle of chamfer is 45 degrees, but this represents only one possible angle, other chamfer angles in the range of from 10 degrees to 80 degrees should be considered within the disclosure of this invention. Also, in the preferred embodiment of the invention, only one layer of diamond is bonded to the substrate. A single chamfer 604 imposed on a single diamond layer 602 improves the manufacturability and cost-performance of the cutter 601. The chamfer 604 is imposed on the diamond layer through well-known grinding or diamond abrasive processes.

Figure 7A:
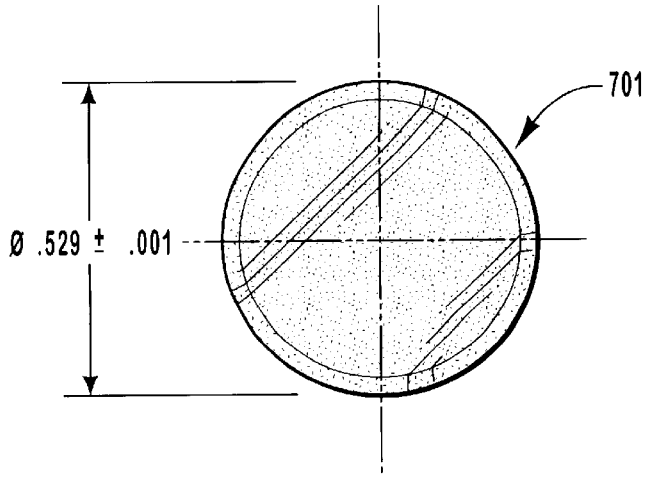
FIG. 7 depicts a preferred embodiment of the invention as used on a cutter with a diamond layer of traditional thickness.
Figure 7B:
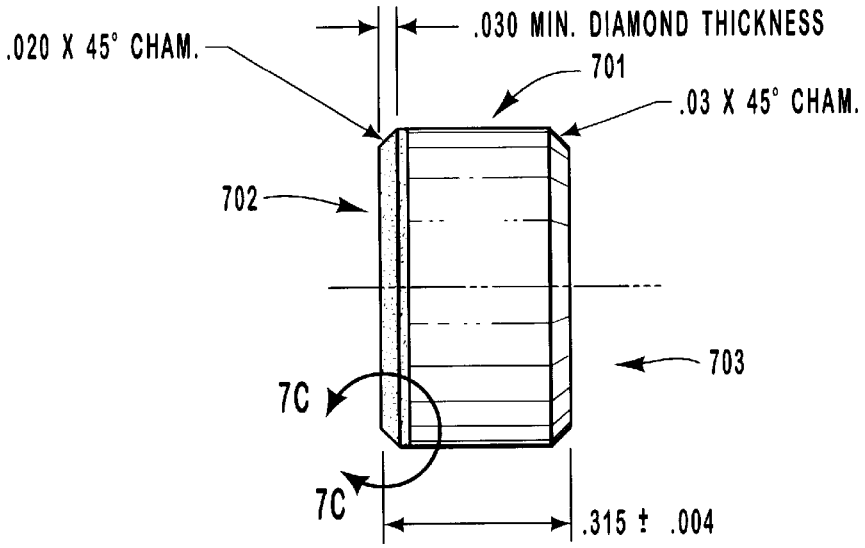
Figure 7C:
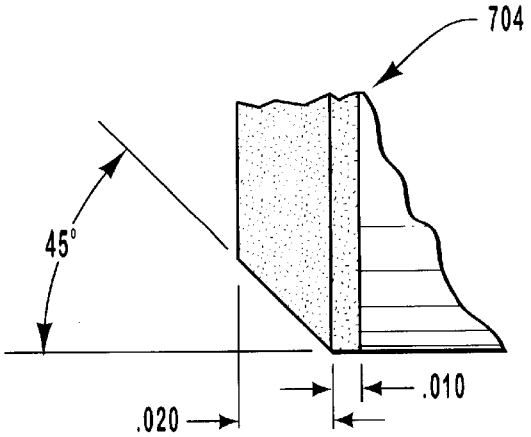

FIG. 7 depicts a cutter 701 with a diamond layer 702 which has a thickness of 0.030 inches. A carbide substrate 703 is affixed to the diamond layer 701. The thickness of the diamond layer 702 is consistent with standard cutters. A chamfer 704 is shown with a depth of 0.020 inches. Again, this embodiment of the invention makes use of a single diamond layer 702 and a single chamfer 704 for the purpose of maximizing the manufacturability and cost-performance of the cutter 701.

What is claimed is:

1. A cutting element for use on a bit for drilling subterranean formations, comprising:

(A) a substrate;

(B) a layer of superabrasive material, having a top and a peripheral edge and a thickness greater than 0.040 inches, said layer of superabrasive material bonded to said substrate; and (C) a chamfer imposed on said peripheral edge of said layer of superabrasive material forming a chamfered region of said superabrasive material comprising the region of said superabrasive material defined by said top, said chamfered peripheral edge and a thickness of greater than 0.020 inches.

2. A cutting element as recited in claim 1, wherein said substrate is selected from the group consisting of tungsten, niobium, zirconium, hafnium, vandium, tatalum, and titanium.

3. A cutting element as recited in claim 1, wherein said layer of superabrasive material is composed of polycrystalline diamond.

4. A cutting element as recited in claim 1, wherein said layer of superabrasive material further comprises: a cutting face; and a longitudinal axis.

5. A cutting element as recited in claim 1, wherein said layer of superabrasive material is between 0.040 inches and 0.070 inches in thickness.

6. A cutting element as recited in claim 1, wherein said single chamfer is between 0.020 inches and 0.035 inches in depth.

7. A cutting element as recited in claim 5, wherein said single chamfer is cut into said layer of superabrasive at an angle of between 10 degrees and 80 degrees as measured relative to said longitudinal axis of said layer of superabrasive material.

8. A cutting element as recited in claim 5 wherein said layer of superabrasive material has a side wall substantially parallel to said longitudinal axis.

9. A cutting element as recited in claim 1, wherein said layer of superabrasive material is substantially circular.

10. A cutting element as recited in claim 9, wherein said single chamfer further comprises an angular cut, cutting away from said cutting face toward said side wall, extending radially and inwardly toward said longitudinal axis.

11. A cutting element as recited in claim 1, wherein said layer of superabrasive material is substantially planar.

12. A cutting element as recited in claim 1, wherein said layer of superabrasive material includes a convex portion.

13. A cutting element as recited in claim 1, wherein said layer of superabrasive material includes a concave portion.

14. A cutting element as recited in claim 1, wherein said substrate is composed of cemented tungsten carbide.

15. A cutting element as recited in claim 1, wherein said layer of superabrasive material is bonded to said substrate by sintering.

16. A cutting element as recited in claim 1, wherein said layer of superabrasive material is bonded to said substrate by welding.

17. A cutting element as recited in claim 1, wherein said layer of superabrasive material is bonded to said substrate by brazing.

18. A cutting element as recited in claim 1, wherein said layer of superabrasive material is composed of cubic boron nitride.

19. An apparatus for drilling subterranean formations, comprising:

A. a substrate;

B. a volume of superabrasive material, said volume of superabrasive material further comprising:

1. a longitudinal axis;
2. a side wall parallel to said longitudinal axis;
3. a cutting face, said cutting face extending generally transverse to said longitudinal axis;
4. a periphery of said cutting face;
5. a cutting edge positioned at said periphery of said cutting face;
6. a single chamfer cut into said cutting face, said single chamfer extending forwardly, inwardly, and generally away from said cutting edge at an angle to said longitudinal axis of between 10 degrees and 80 degrees and for a width of greater than 0.020 inches and less than 0.036 inches as measured along said side wall of said cutter.

20. An apparatus for drilling as recited in claim 19, wherein said volume of superabrasive material has a thickness, said thickness measured parallel to said longitudinal axis and adjacent to said cutting edge, said thickness being not less than 0.040 inches and not more than 0.069 inches in length.

21. An apparatus for drilling as recited in claim 19, wherein said angle of said chamfer measured relative to said longitudinal axis is between 10 degrees and 80 degrees.

* * * * *

UNITED STATES PATENT AND TRADEMARK OFFICE

CERTIFICATE OF CORRECTION

PATENT NO. : 5,979,579
APPLICATION NO. : 08/893832
DATED : November 9, 1999
INVENTOR(S) : Stephen R. Jurewicz It is certified that error appears in the above-identified patent and that said Letters Patent is hereby corrected as shown below:

On title page Item
[73] Assignee: US Synthetic Corporation, Orem, Utah

Signed and Sealed this

Tenth Day of July, 2007

JON W. DUDAS
*Director of the United States Patent and Trademark Office*